US005493819A

United States Patent [19]

Acosta-Torres

[11] Patent Number: 5,493,819

[45] Date of Patent: Feb. 27, 1996

[54] SEAL MOLDING FOR CORRUGATED ROOFING

[76] Inventor: Aldo Acosta-Torres, IIC-01 Box 11047, Lajas, Puerto Rico, 00667-9712

[21] Appl. No.: 337,011

[22] Filed: Nov. 7, 1994

[51] Int. Cl.[6] ..... E04B 7/04

[52] U.S. Cl. ..... 52/94; 52/93.2; 52/309.7; 52/309.8; 52/403.1; 52/DIG. 15

[58] Field of Search ..... 52/94, DIG. 15, 52/309.4, 309.7, 309.8, 403.1, 93.2, DIG. 16; 277/206 R, 207 A, 213, DIG. 6; 428/161, 163, 182, 184, 186, 304.4, 318.4, 537.1

[56] References Cited

U.S. PATENT DOCUMENTS

| | | | |
|---|---|---|---|
| 2,853,330 | 9/1958 | Harry . | |
| 3,385,018 | 5/1968 | Harry . | |
| 3,511,007 | 5/1970 | Babcock . | |
| 4,017,090 | 4/1977 | Cohen | 52/94 X |
| 4,401,705 | 8/1983 | Ewert . | |

FOREIGN PATENT DOCUMENTS

| | | | |
|---|---|---|---|
| 471427 | 2/1973 | Australia | 52/94 |
| 2020724 | 11/1979 | United Kingdom . | |

*Primary Examiner*—Carl D. Friedman
*Assistant Examiner*—Christopher Todd Kent
*Attorney, Agent, or Firm*—Richard C. Litman

[57] ABSTRACT

This invention is directed to a device which, when installed, effectively seals the spaces formed at the junction of a corrugated roofing element and a vertical support structure. A compressible material of fixed height is affixed to a rigid support member, both of which extend the length of the junction of the roof overhang and the vertical support structure. The device is pressed upwards into the junction, compressing the foam into the channels formed by the corrugated roofing element, and the rigid support member is then attached to the vertical support member.

4 Claims, 2 Drawing Sheets

SEAL MOLDING FOR CORRUGATED ROOFING

BACKGROUND OF THE INVENTION

1. Field of the Invention

The present invention relates generally to roofing, and more particularly to an improved sealing element for corrugated roofing.

2. Background of the Invention

Corrugated sheets or panels have long been recognized as an economical and efficient means for roofing. As well as being inexpensive, the sheets are durable, heat resistant and channel water runoff more efficiently than most other types of roofing. While providing many advantages, corrugated roofing also has several drawbacks. Most significantly, the very structure of the corrugated channels limits the ability by which it may be sealed to any underlying, supporting planar object, such as a wall, truss or similar support structure.

There have been a variety of items used to seal the spaces caused by corrugated sheeting, each producing additional problems when employed. Cement or plaster may be applied to the spaces, Over time, however, these materials shrink, disintegrate and separate from the roofing causing a new gap or space to form and allowing ingress of foreign elements. Preformed moldings which are contoured to the sinusoidal shape of the corrugated sheets have been proposed but such devices cannot account for variations in the curvature of the sheeting and therefore, generally, provide an inadequate seal. In the actual setting of any installation, hardly any corrugated panel will present a perfect configuration of perfectly formed alternate crests and valleys due to slight manufacturing variations and mostly due to shipping and handling to the job site. This latter handling produces dents and other deformations in the panels while further imperfections will become obvious when panels are anchored to the building roofing supporting structure.

3. Description of the Prior Art

U.S. Pat. Nos. 2,853,330 and 3,385,018, issued to H. A. Harry on Sep. 23, 1958 and May 28, 1968, respectively, show sealing elements for use with corrugated sheeting. Both elements are contoured to generally correspond with the sinusoidal variations of the crests and valleys of corrugated sheeting, and each has attached to it a resilient element which will accommodate small variations when pressure is applied. Neither of these inventions will accommodate large variations in the corrugations, or corrugated sheets having larger or smaller crest and valley sinusoidal variations than the corresponding variations of the preformed, contoured sealing element.

U. S. Pat. No. 4,401,705, issued to A. Ewert on Aug. 30, 1983 shows a molding element designed to allow a corrugated sheet to be connected to a support structure. This molding is similar to the Harry patents discussed above, in that it has a prefabricated sinusoidal shape. The '705 patent lacks any resilient member which would accommodate variations and thus would provide only a minimal seal and only for corrugated sheets having the same size corrugations.

U.K. Patent No. 2,020,724, issued to M. J. Turner on Nov. 21, 1979, illustrates a closure element for corrugated sheeting. An end cap closes off the end of the sheet while allowing an air to flow into the lower spaces between adjacent valleys. This device would appear not to entirely seal off the roofing, nor would it adequately close off all sizes of corrugated sheeting.

U.S. Pat. No. 3,511,007 issued to H. N. Babcock on May 12, 1970 shows a structural system which allows for the insertion of foam into the underside of various structures, such as roofing or decking.

None of the above inventions and patents, taken either singly or in combination, is seen to describe the instant invention as claimed.

SUMMARY OF THE INVENTION

The present invention overcomes the above mentioned shortcomings by providing for a universal sealing element particularly suited for corrugated roofing.

Accordingly, it is an object of the invention to provide a sealing element for corrugated roofing including a mounting element supporting a sealing element formed of a sufficiently resilient material to accommodate a wide range of variations in the height beneath the roofing.

It is another object of the invention to provide a sealing element for corrugated roofing wherein a resilient layer of the sealing element is ample enough to conform to corrugations having a variety of widths and heights as well as having various shapes and configurations.

It is a further object of the invention to provide a sealing element for corrugated roofing wherein a resilient layer is formed of a material that adequately absorbs paint or other coating material in such a manner as to form an impervious barrier to the elements as well as vermin and the like.

Still another object of the invention is to provide a sealing element for corrugated roofing that when properly coated, with paint or similar material, resists natural decay and degradation to provide an effective long term seal.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
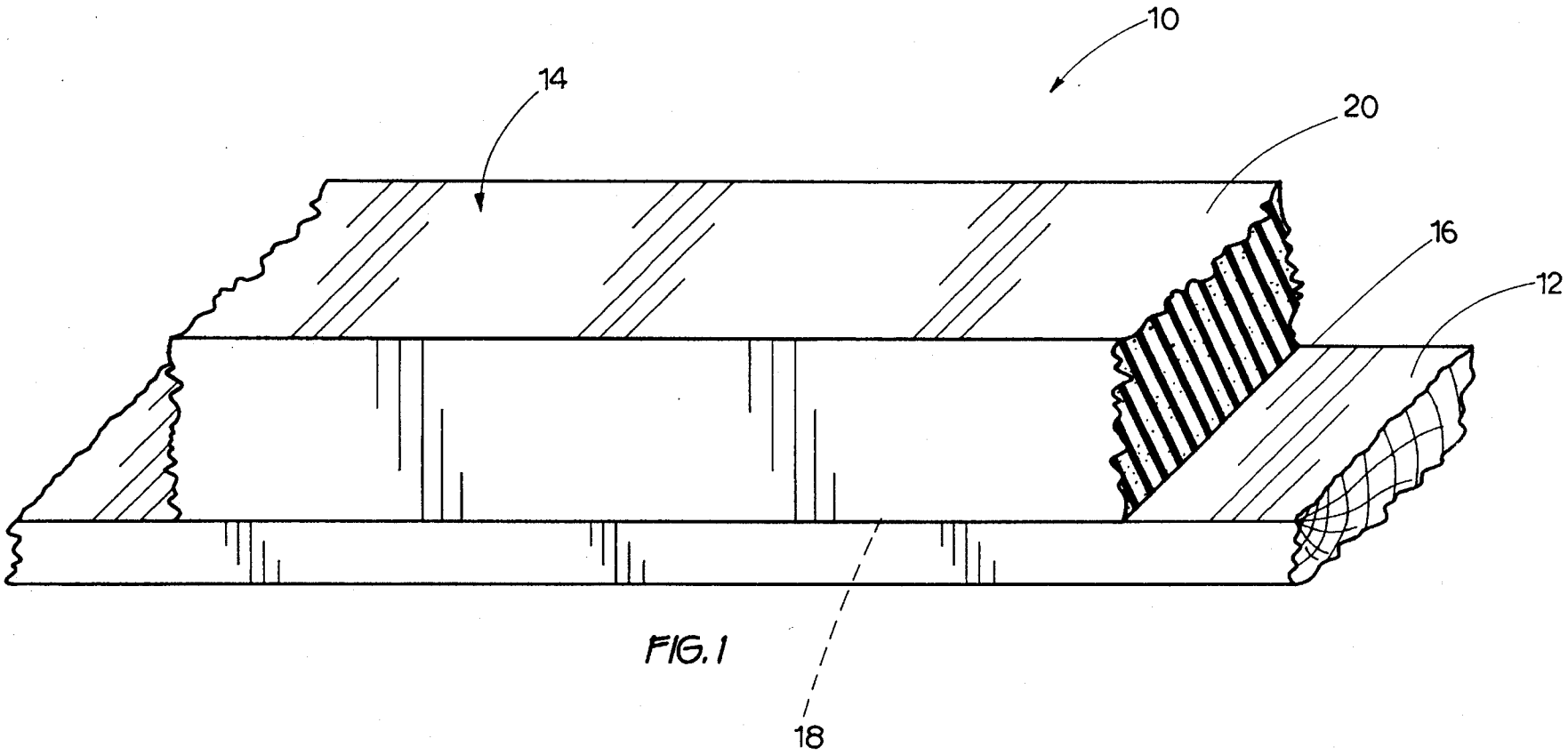
FIG. 1 is a front elevational view of the sealing element as attached to a building structure.
Figure 2:
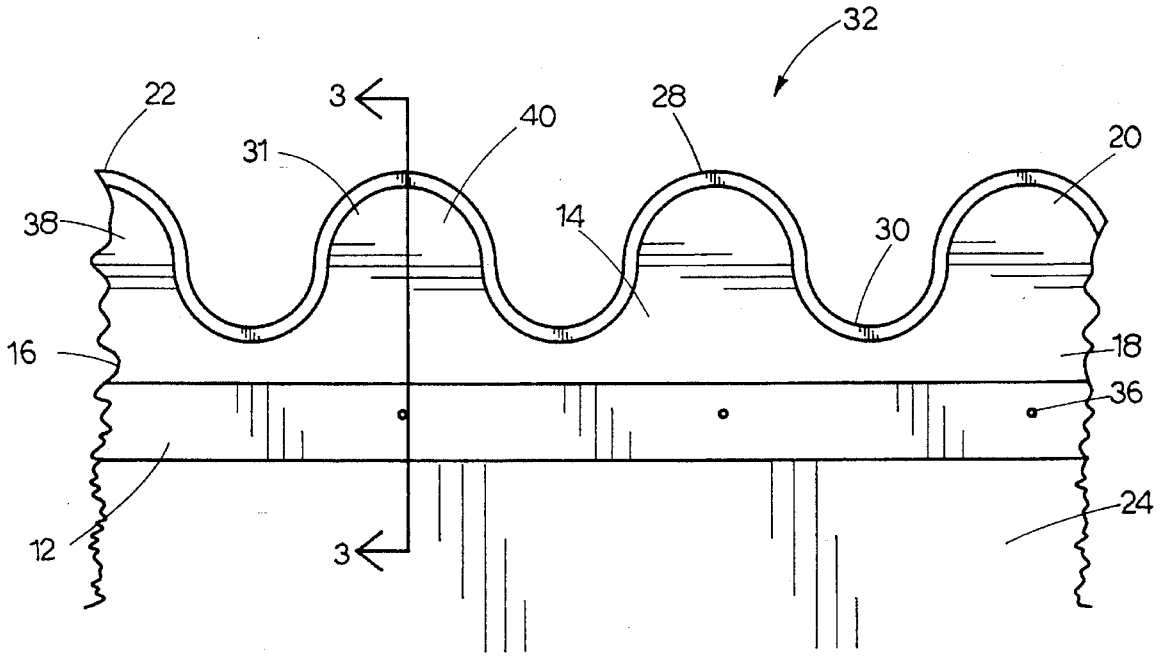
FIG. 2 is a front perspective view of the sealing element.
Figure 3:
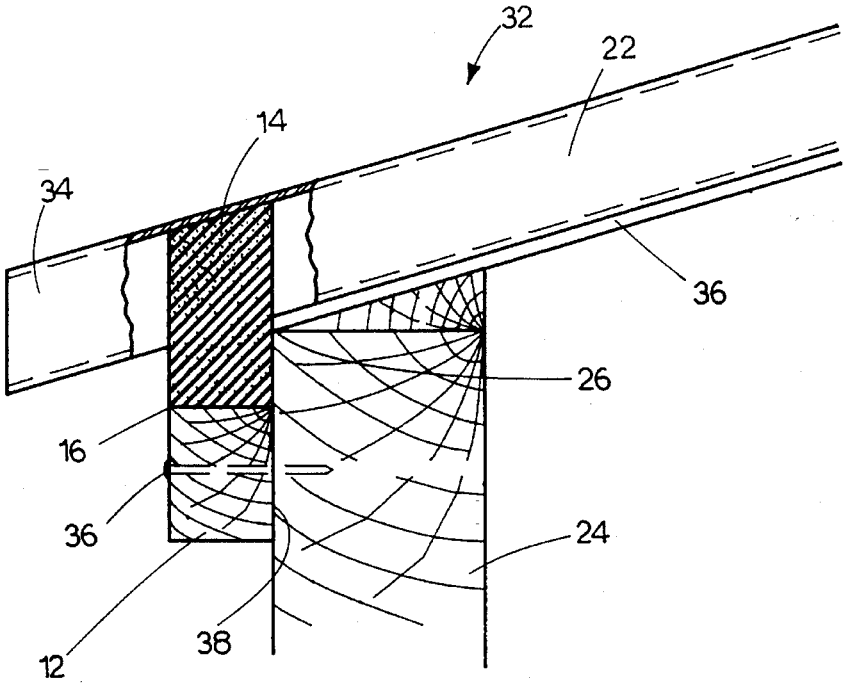
FIG. 3 is a fragmentary view of a cross-section taken from the line 3—3.

Turning now to FIG. 1 of the drawings, an elongated composite sealing member 10 is shown having a rigid mounting base 12 which may be made of any suitable material, such as wood, metal, plastic, or the like. Abutting the base 12 along a planar junction 16 is a compressible seal element 14 made of a sufficiently resilient material, such as expanded foam or sponge, permissive of substantial compressibility. The lower surface 18 of the compressible seal element 14 may be attached to the base 12 with an adhesive or similar means to provide a secure assembly of the two components. The seal element is formed with a planar upper surface thus providing a constant height when the seal element is in the normal, at rest condition of FIG. 1. The upper surface 20 engages the corrugated roofing panel 22 where the roofing panel 22 meets the vertical exterior building member 24. The junction 16 of the sealing member will generally remain sufficiently below the line of intersection 26 between the corrugated roofing panel 22 and the exterior wall 24 or sheathing 36 if used, in order to allow for the increased density of the compressible sealing element 14 as it conforms to the crests 28 and valleys 30 of the corrugated roofing panel.

Generally, when a corrugated roofing panel 22 is used in a roofing installation 32, the corrugated panel is allowed to form an overhang 34, extending beyond the exterior wall 24 and sheathing 36. While this overhang is advantageous in many ways, such as directing water runoff away from the side of the structure 24, it also presents several drawbacks. The crests 28 and valleys 30 of the corrugated sheet provide gaps or openings 31 beneath the roofing sheet 22 and either the interior of the structure or atop the sheathing 36. At the very least, the openings 31 cause spaces to be formed between the corrugated panel 22 and the sheathing. This situation allows access for the elements as well as vermin, both of which will cause deterioration of the roofing panel and the sheathing, if it is in place. To seal these spaces, the inside face 38 of the rigid mounting base 12 is placed against the exterior building member 24 and/or sheathing 36 with the compressible element's lower surface 18 disposed in a plane below the line of intersection 26. Upward pressure is applied to the sealing element 10 causing the compressible sealing element 14 to fill in and conform to the crests 28 and to be compressed and conform to the valleys 30 of the corrugated panel 22, effectively sealing the gaps 31 created by the corrugated panel 22. Suitable fastening means 36, such as nails, screws or other headed fasteners are employed to attach the sealing member 10 to the exterior wall 24, while maintaining upward pressure on the compressible seal element 14. At this point, paint or other suitable coating material 38 may be applied to the outer face 40 of the compressible seal element 14 in order to harden the resilient material and prevent any further absorption of liquid materials as well as to reduce the degradation of the resilient material.

It is to be understood that the present invention is not limited to the sole embodiment described above, but encompasses any and all embodiments within the scope of the following claims.

I claim:

1. A roofing installation comprising;

a corrugated roofing panel having adjacent crests and valleys mounted atop a vertical exterior building member and presenting an overhang extending beyond said building member, an elongated composite sealing member including a compressible seal element having an elevated upper surface initially extending substantially in a straight line and an opposite lower surface abutting a rigid mounting member, said seal element presenting an at-rest height no less than the height of the crests of said corrugated roofing panel, and exhibiting a substantially constant cross-section throughout its length, and said mounting member having an inside face fixed relative to said building member with said seal element upper surface engaging the crests and valleys of said corrugated roofing panels as said seal element is variably compressed and the height of said seal element is continuously altered between said adjacent crests and valleys, whereby said compressible seal element conforms to the configuration of said corrugated roofing panels to substantially fill the previously existing spaces beneath said panels adjacent said building member to discourage the ingress of weather elements and vermin beneath said panels.

2. The roofing installation according to claim 1, including penetrating fastening means attaching said mounting member to said building member.

3. The roofing installation according to claim 1, wherein said lower surface of said compressible seal element is disposed below the line of intersection of said corrugated roofing panel and said vertical building member to allow for the increased density of the compressible element as it conforms to the structure the corrugated roofing panel.

4. The roofing installation according to claim 1, including a protective coating on said compressible seal element to prevent the further absorption of liquid elements as well as to deter the physical deterioration of said compressible seal element.

* * * * *